US006406348B1

(12) United States Patent
Pearce

(10) Patent No.: US 6,406,348 B1
(45) **Date of Patent: *Jun. 18, 2002**

(54) MUSICAL DRINKS VESSELS

(75) Inventor: Walter Pearce, Newport (GB)

(73) Assignee: Textformat Limited, Gwent (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/495,414

(22) Filed: Jan. 31, 2000

(30) Foreign Application Priority Data

Feb. 3, 1999 (GB) ..... 9902291

(51) Int. Cl.[7] ..... A63H 5/00; A63H 29/10; A61J 9/00; G06M 7/00

(52) U.S. Cl. ..... 446/81; 446/175; 215/11.1; 215/378; 250/221

(58) Field of Search ..... 446/267, 81, 175, 446/219; 215/11.1, 11.6, 378; 200/187, 61.02

(56) References Cited

U.S. PATENT DOCUMENTS

| | | | | |
|---|---|---|---|---|
| 3,627,161 A | | 12/1971 | Wergeland | |
| 4,033,453 A | | 7/1977 | Giaimo | |
| 4,184,072 A | | 1/1980 | Sandford et al. | |
| 4,209,735 A | | 6/1980 | Yoshida | |
| 4,369,498 A | | 1/1983 | Schulte | |
| 4,678,093 A | | 7/1987 | Allen | |
| 4,756,222 A | | 7/1988 | Armato | |
| 4,898,060 A | | 2/1990 | To | |
| 4,944,704 A | | 7/1990 | Grace | |
| 5,382,204 A | | 1/1995 | Green | |
| 5,489,893 A | | 2/1996 | Jo et al. | |
| 5,536,196 A | * | 7/1996 | Sternberg | 446/81 |
| 5,664,745 A | | 9/1997 | Hadaway | |
| 5,668,333 A | | 9/1997 | Horton et al. | |
| 5,842,901 A | | 12/1998 | Montgomery | |
| 6,024,625 A | * | 2/2000 | Pearce | 446/81 |

FOREIGN PATENT DOCUMENTS

| | | |
|---|---|---|
| GB | 2185898 | 8/1987 |
| GB | 2225474 | 5/1990 |

* cited by examiner

*Primary Examiner*—D. Neal Muir
(74) *Attorney, Agent, or Firm*—Vedder Price Kaufman & Kammholz

(57) ABSTRACT

A musical drinks vessel comprises a hollow body 10 for holding the beverage and a sound generating assembly having an electrically operated sound generating device 11,12 sealingly mounted therein. The sound generating device 11,12 is activated when the amount of light incident on a photodiode thereof exceeds a predetermined level. A shutter 21 is provided for obscuring light from the photodiode, when it is desired to deactivate the sound generating device 11,12. The shutter enables the device 11,12 to be activated and deactivated simply and remotely, without any physical connection to the device that could allow the ingress of liquid or steam liquid when the device is being washed or sterilised.

11 Claims, 2 Drawing Sheets

MUSICAL DRINKS VESSELS

BACKGROUND OF THE INVENTION

This invention relates to musical drinks vessels, including drinking vessels suitable for use as a trainer cup or the like.

Trainer cups are known for use by young children to bridge the gap between use of a baby's feeding bottle and use of a normal cup or glass. Typically, trainer cups comprise a cup or mug provided with a lid having a mouthpiece associated therewith, usually in the form of a spout.

Trainer cups are often the child's first step in learning to feed itself after a baby's feeding bottle, however, many children find it difficult to progress from a feeding bottle to a trainer cup, owing to the comfort that is provided by a baby's feeding bottle.

Accordingly, it is desirable to provide something on the trainer cup, which will provide comfort as well as something which will help the child take to the cup.

Musical baby feeding bottles are known for providing comfort to babies whilst feeding. Typically, such known musical baby bottles comprise a container for holding liquid and an electrically or mechanically operated music generating device. It is important to wash and sterilise babies feeding bottles, however, a disadvantage of this is that emersion in water and steam or sterilising fluid can damage the music generating device.

U.S. Pat. No. 4,678,093 discloses a musical baby bottle comprising a container having an electrically operated music generated device sealed in its base. The device is activated by means of a mercury tilt switch, thereby obviating any need to have an external switch which may let in water or moisture.

A disadvantage of mercury tilt switches is that mercury is poisonous and furthermore the music generating device will only remain active as long as the baby is moving, which is not always the case when the baby is feeding. Another disadvantage is that it is not possible to turn the device off, say whilst the bottle is being carried in a bag and thus music can be played at undesirable times, which is both embarrassing and annoying.

We have now devised a musical drinks vessel that alleviates the above mentioned problems.

SUMMARY OF THE INVENTION

In accordance with this invention, there is provided a musical drinks vessel comprising a hollow body for holding the drink and a sound generating assembly having an electrically operated sound generating device sealingly mounted therein, said device having light sensitive activation means directed through a transparent wall of assembly, the drinks vessel further comprising shutter means on the opposite side of said wall for moving between first and second positions in which the amount of light incident on the activation means is different.

The music generating device is sealingly mounted in the assembly and thus water etc. is unable to come into contact with the device. However, the device can be remotely activated and deactivated by moving the shutter between the first and second position, thereby varying the amount of light incident on the light sensitive activation means.

The shutter can be left in the first or second positions so that the device is permanently activated or deactivated.

Preferably the sound generating device is activated when the amount of light incident on the activation means is above a predetermined level and deactivated when the amount of light is below a predetermined level.

In one embodiment, the assembly is permanently attached to the body of the drinks vessel, thereby alleviating the risk that it may get lost or forgotten.

In this embodiment, the sound generating device and activation means may be sealingly mounted inside a housing which is permanently fitted to the underside of the body of the drinks vessel.

Alternatively, the sound generating device and activation means may be sealingly mounted inside the hollow body of the drinks vessel, preferably adjacent a bottom wall thereof.

Alternatively, the sound generating device and activation means may be sealingly mounted in a recess formed in a bottom wall of the body of the drinks vessel.

In an alternative embodiment, the assembly is detachable from the body of the drinks vessel, so that if desired, it can be removed whilst the body of the drinks vessel is being washed or sterilised.

Preferably the assembly is disposed at the base of the body of the drinks vessel, the activation means being directed through a transparent wall which faces downwardly when the drinks vessel is stood in an upright position.

Thus, the device can also be activated and deactivated when the drinks vessel is picked up and set down.

In one embodiment, the shutter means is detachable from the assembly, the shutter means comprising means for engaging the assembly. The shutter means may comprise a cap which engages with the assembly, say by means of a push or screw fitting.

In an alternative embodiment, the shutter means is slidably or rotatably mounted to the assembly.

Preferably, the drinks vessel comprises a mug or cup. Preferably, the mug or cup comprises at least one handle.

Preferably, the mug or cup comprises a lid having a mouthpiece associated therewith, preferably in the form of a spout.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DETAILED DESCRIPTION OF THE PREFERRED EMBODIMENTS

Figure 1:
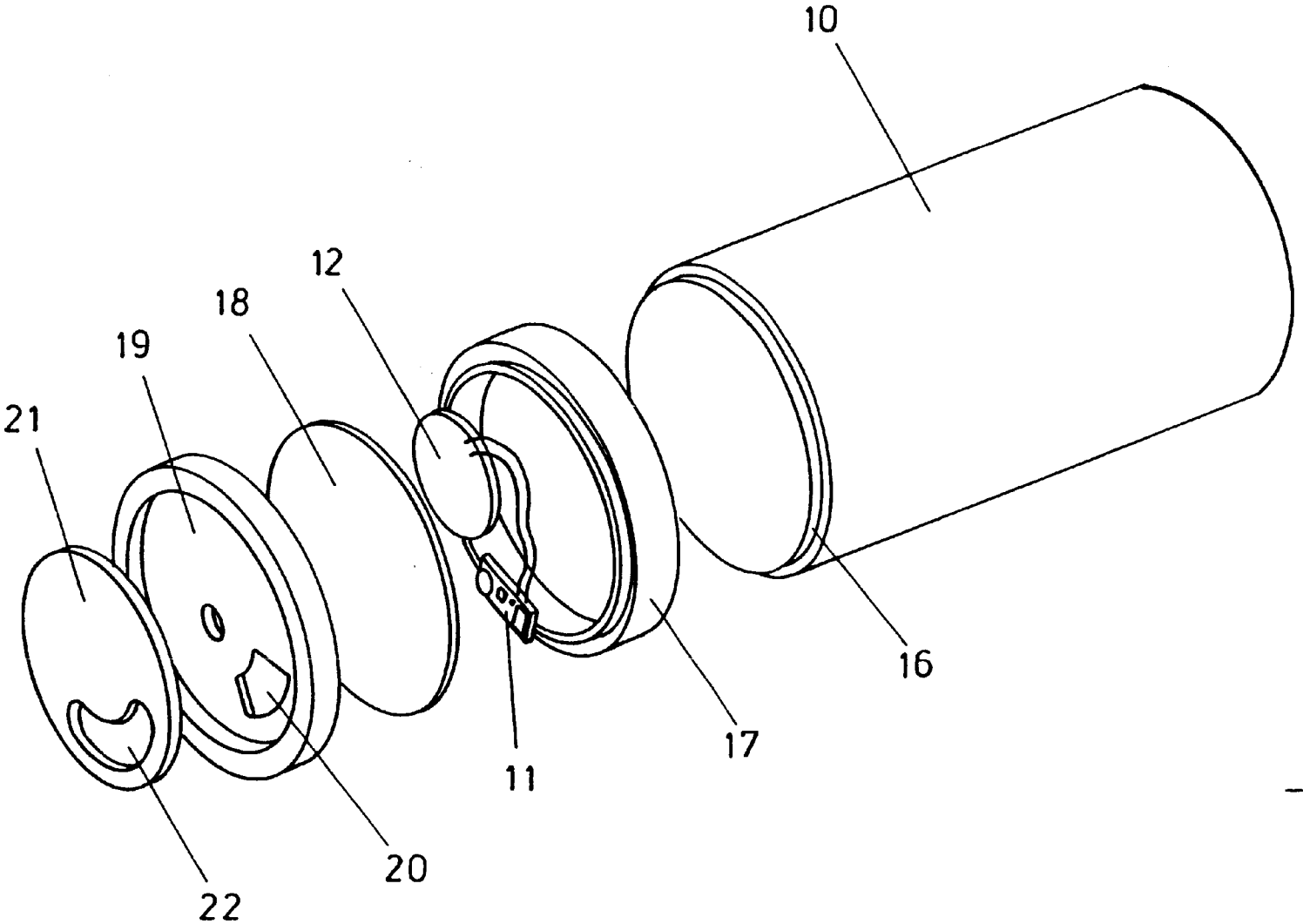
FIG. 1 is an exploded view in perspective of an embodiment of musical trainer cup in accordance with this invention; and, FIG. 2 is an exploded view in perspective of an alternative embodiment of musical trainer cup in accordance with this invention.

Referring to FIG. 1 of the drawings, there is shown a musical trainer cup comprising a conventional cup-shaped body 10 formed of moulded plastics material having a sound generating assembly fitted to its underside. A lid (not shown) having a mouthpiece in the form of a spout is provided for fitting to the top of the body of the cup.

The sound generating assembly comprises a battery-operated sound generating device of the type used in novelty greetings cards having a printed circuit board 11 including an integral photodiode, and a piezo-electric loudspeaker 12 attached to the printed circuit board 11 by wires. In use, the photodiode activates the device in the event that the amount of light that is incident thereon exceeds a predetermined level.

The sound generating device is mounted in a recess formed in the underside of a circular plastics housing 17 of the assembly, which is arranged to snap-engage with a lip 16 that extends around the underside of the body of the cup 10. The external diameter of the housing 17 corresponds with the external diameter of the body of the cup 10. A circular window 18 of transparent plastics material is fitted to the underside of the housing, in order to seal the sound generating device in the recess. Alternatively, the recess in the housing 17 may be filled with a transparent thermosetting plastics material 14 which encapsulates the sound generating device.

The printed circuit board 11 is mounted such that the photodiode thereon is directed downwardly through the transparent window 18.

A circular cover 19 for the housing is snap engaged to the underside of the housing 17. The cover 19 comprises an aperture 20, which is disposed in line with the photodiode. A disc 21 is rotatably mounted in a circular recess formed in the underside of the cover 19. An arcuate aperture 22 is formed in the disc 21 at a point radially outward of its centre.

The sound generating device can be activated by rotating the disc 21 to a position in which its aperture 22 is aligned with the aperture 20 in the cover 19 and with the photodiode, thereby allowing light to reach the photodiode through the aligned apertures 20,22.

The device 11 emits music, such as a nursery rhyme, when it is activated and we have found that this helps to comfort children, as well providing a form of amusement, which helps children take to the use of a trainer cup more quickly.

The device is deactivated by rotating the disc 21 to a position in which it obscures the photodiode. Alternatively, the device 11 can be deactivated by standing the cup on a surface, such that light is shielded from the photodiode.

Whilst the cup is being carried away from the home, the disc 21 can be rotated to the position in which it obscures the photodiode, in order to prevent music from being played and to preserve the battery.

The assembly can be detached from the body 10 of the cup, whilst the latter is being washed and sterilised, in order to prevent music from being played and in order to prevent the assembly from being damaged by the sterilising liquid or steam.

Figure 2:
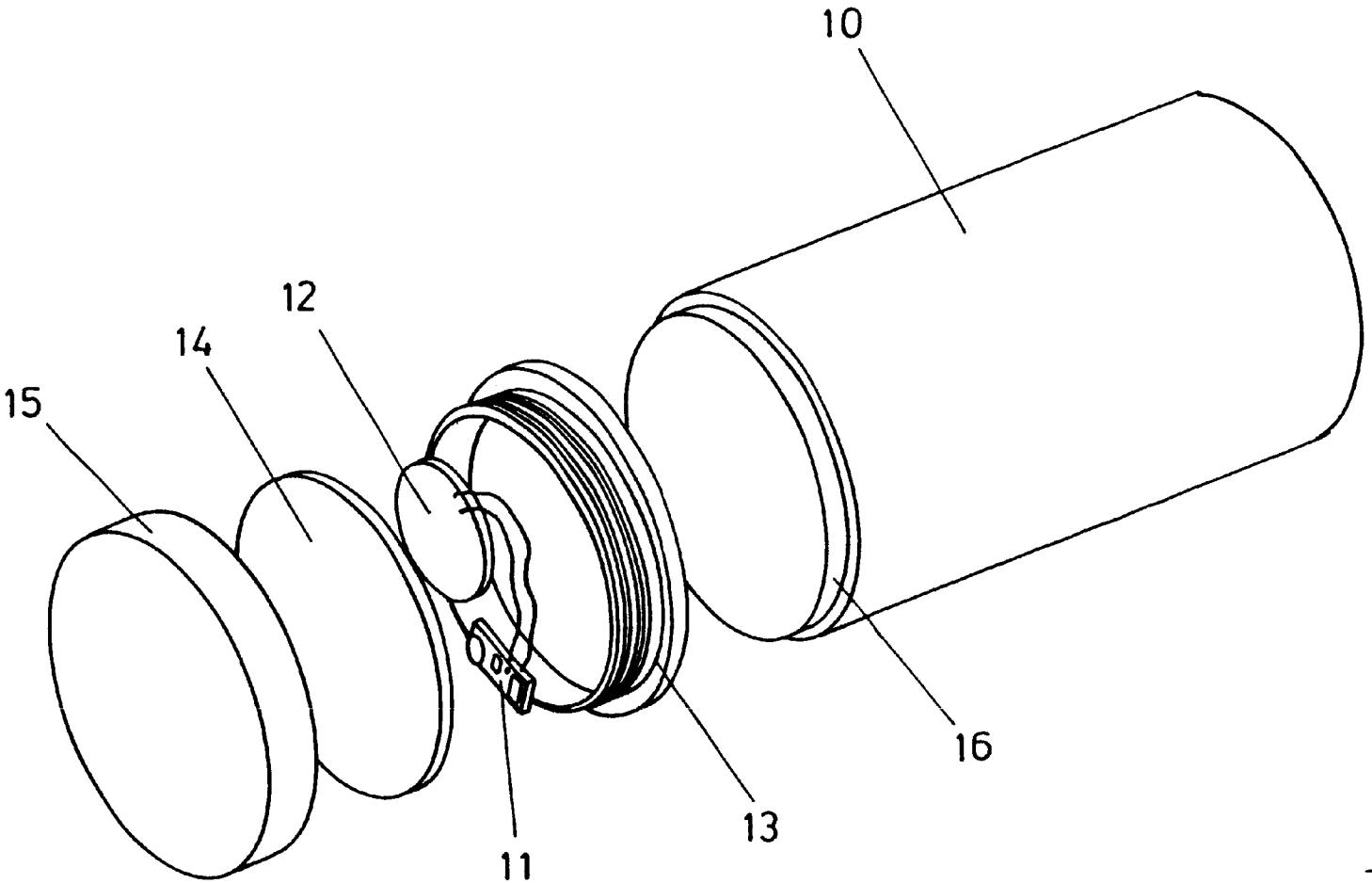

Referring to FIG. 2 of the drawings, there is shown an alternative embodiment of musical trainer cup and like parts are given like reference numerals. The drinks cup again comprises a conventional cup-shaped body portion 10 formed of plastics material having a sound generating assembly fitted to its underside.

The sound generating assembly comprises a similar sound generating device mounted inside a recess formed in the underside of a plastics housing 13 of the assembly, which is arranged to snap-engage with a lip 16 that extends around the underside of the body of the cup 10. A circular window 14 of transparent plastics material seals the sound generating device in the recess of the housing 13. The sound generating device is mounted such that the photodiode thereon is directed downwardly through the window 14.

The housing 13 of the assembly is externally screw-threaded and an internally screw-threaded cap 15 of opaque plastics material is provided for fitting to the housing 13, in order to obscure the window 14.

The cap 15 is normally screwed to the housing 13, when the cup is not in use. The cap 15 is opaque and thereby light is prevented from illuminating the photodiode. The sound generating device can be activated by unscrewing the cap 15, so that light illuminates the photodiode 12 through the window 14 in the bottom of the housing 13.

The device can be deactivated either by standing the cup on a surface, such that light is shielded from the photodiode or by refitting the cap 15.

The assembly can again be detached from the body 10 of the cup, whilst the latter is being washed and sterilised.

While the preferred embodiment of the invention have been shown and described, it will be apparent to those skilled in the art that changes and modifications may be made therein without departing from the spirit of the invention, the scope of which is defined by the appended claims.

I claim:

1. A musical drinks vessel comprising: a hollow body for holding the drink and a sound generating assembly having an electrically operated sound generating device sealingly mounted therein, said device having light sensitive activation means directed through a transparent wall of the assembly, the vessel further comprising shutter means on the opposite side of said transparent wall for moving between first and second positions in which the amount of light incident on the activation means respectively activates or deactivates said sound generating device.

2. A musical drinks vessel as claimed in claim 1, in which the assembly is permanently attached to the body of the vessel.

3. A musical drinks vessel as claimed in claim 2, in which the sound generating device and activation means are be sealingly mounted inside a housing which is permanently fitted to the underside of the body of the vessel.

4. A musical drinks vessel as claimed in claim 2, in which the sound generating device and activation means are be sealingly mounted inside the hollow body of the vessel.

5. A musical drinks vessel as claimed in claim 4, in which the sound generating device and activation means are be sealingly mounted inside the hollow body of the vessel, adjacent a bottom wall thereof.

6. A musical drinks vessel as claimed in claim 2, in which the sound generating device and activation means are be sealingly mounted in a recess formed in a bottom wall of the body of the vessel.

7. A musical drinks vessel as claimed in claim 1, in which the assembly is detachable from the body of the vessel.

8. A musical drinks vessel as claimed in claim 7, in which the assembly is disposed at the base of the body of the vessel, the activation means being directed through a transparent wall which faces downwardly when the vessel is stood in an upright position.

9. A musical drinks vessel as claimed in claim 1, in which the shutter means is detachable from the assembly, the shutter means comprising means for engaging the assembly.

10. A musical drinks vessel as claimed in claim 1, in which the shutter means is slidably mounted to the assembly.

11. A musical drinks vessel as claimed in claim 1, in which the shutter means is rotatably mounted to the assembly.

* * * * *